US010320103B2

(12) United States Patent
Gui

(10) Patent No.: US 10,320,103 B2
(45) Date of Patent: Jun. 11, 2019

(54) ELECTRICAL CONNECTOR CAPABLE OF INCREASING NUMBER OF TERMINALS WITH SAME SIZE OF INSULATING BODY

(71) Applicant: LOTES CO., LTD, Keelung (TW)

(72) Inventor: Xiao Guang Gui, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/031,081

(22) Filed: Jul. 10, 2018

(65) Prior Publication Data

US 2019/0020135 A1 Jan. 17, 2019

(30) Foreign Application Priority Data

Jul. 17, 2017 (CN) ..... 2017 1 0580356

(51) Int. Cl.

| | |
|---|---|
| ***H01R 13/62*** | (2006.01) |
| ***H01R 12/71*** | (2011.01) |
| *H01R 13/64* | (2006.01) |
| *H01R 12/70* | (2011.01) |

(52) U.S. Cl.

CPC ..... *H01R 12/716* (2013.01); *H01R 12/7076* (2013.01); *H01R 13/64* (2013.01)

(58) Field of Classification Search

CPC .. H05K 7/1069; H05K 7/1023; H05K 7/1053; H05K 7/1038; H01R 13/62933

USPC ..... 439/71–73, 330–331, 372, 525–526

See application file for complete search history.

(56) References Cited

U.S. PATENT DOCUMENTS

| | | | | |
|---|---|---|---|---|
| 6,932,622 | B2 * | 8/2005 | Liao | H05K 7/1053 439/331 |
| 7,001,186 | B1 * | 2/2006 | Chen | H01R 13/22 439/331 |
| 7,134,898 | B2 * | 11/2006 | Ma | H01R 12/88 439/342 |
| 7,189,093 | B2 * | 3/2007 | Ma | H05K 7/1053 439/331 |
| 7,361,029 | B2 * | 4/2008 | Hashimoto | H05K 7/1053 439/264 |

(Continued)

FOREIGN PATENT DOCUMENTS

| | | |
|---|---|---|
| CN | 2651955 Y | 10/2004 |
| CN | 2909630 Y | 6/2007 |
| CN | 201113145 Y | 9/2008 |

*Primary Examiner* — Thanh Tam T Le

(74) *Attorney, Agent, or Firm* — Locke Lord LLP; Tim Tingkang Xia, Esq.

(57) ABSTRACT

An electrical connector includes a body, having a bottom wall and first and second side walls extending upward from the bottom wall. The bottom wall is provided with an accommodating hole, and a first supporting portion extending upward from the bottom wall to support a chip module. Multiple terminals are correspondingly accommodated in the body. One of the terminals is accommodated in the accommodating hole. A first protruding block and a second protruding block are respectively connected to the first and second side walls and extend toward each other, and each has an arc-shaped surface. The first supporting portion is connected to the first protruding block. The first supporting portion and the accommodating hole are located at two opposite sides of the first protruding block. An extending line of the second protruding block in an extending direction thereof passes above the accommodating hole.

20 Claims, 10 Drawing Sheets

(56) References Cited

U.S. PATENT DOCUMENTS

| | | | | |
|---|---|---|---|---|
| 7,435,104 | B2 * | 10/2008 | Yu | H05K 7/1053 439/331 |
| 7,497,716 | B2 * | 3/2009 | Hsu | H05K 7/1061 439/331 |
| 7,563,107 | B2 * | 7/2009 | Liao | H01R 13/2442 439/71 |
| 7,867,004 | B2 * | 1/2011 | Ma | H05K 7/1069 439/331 |
| 7,883,352 | B2 * | 2/2011 | Taguchi | H01R 13/2442 439/331 |
| 7,887,356 | B1 * | 2/2011 | Cheng | H05K 7/1069 439/331 |
| 8,506,316 | B2 * | 8/2013 | Tsai | H05K 7/1061 439/331 |
| 8,622,278 | B1 * | 1/2014 | Alvarez | H05K 13/0465 228/212 |

* cited by examiner

1

ELECTRICAL CONNECTOR CAPABLE OF INCREASING NUMBER OF TERMINALS WITH SAME SIZE OF INSULATING BODY

CROSS-REFERENCE TO RELATED PATENT APPLICATION

This non-provisional application claims priority to and the benefit of, pursuant to 35 U.S.C. § 119(a), patent application Serial No. CN201710580356.0 filed in China on Jul. 17, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector electrically connecting a chip module.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Chinese Patent No. CN200620070312.0 discloses an electrical connector assembly, including an insulating body and a plurality of conductive terminals arranged in the insulating body in a matrix. The conductive terminal may be electrically conducted with a chip module thereon. The insulating body includes a bottom wall and side walls extending upward from the periphery of the bottom wall. Each of the opposite side walls of the insulating body are provided with a semi-cylindrical post. The chip module includes recesses corresponding to the posts on the side walls of the insulating body. The posts achieve a fool-proof effect on assembling of the chip module to prevent the chip module from being reversely mounted.

However, as a chip module has a tendency of high density and high speed, conductive terminals of the electrical connector are arranged more densely and are increasing in number. At this time, on the premise of keeping the size of the insulating body unchanged, a problem to be solved by the existing electrical connector is how to increase the number of terminals.

Therefore, a heretofore unaddressed need to design a novel electrical connector exists in the art to address the aforementioned deficiencies and inadequacies.

SUMMARY

The invention is directed to an electrical connector capable of increasing the number of terminals on the premise of keeping the size of an insulating body unchanged.

To achieve the foregoing objective, the present invention adopts the following technical solutions.

An electrical connector, configured to be electrically connected to a chip module, includes: a body, having a bottom wall and a first side wall and a second side wall extending upward from the bottom wall and opposite to each other, wherein the bottom wall is provided with an accommodating hole, and a first supporting portion extending upward from the bottom wall and configured to support the chip module; a plurality of terminals, correspondingly accommodated in the body, wherein one of the terminals is accommodated in the accommodating hole; and a first protruding block connected to the first side wall and a second protruding block connected to the second side wall, wherein the first protruding block and the second protruding block extend toward each other, the second protruding block is larger than the first protruding block, the first protruding block has a first arc-shaped surface, the second protruding block has a second arc-shaped surface, the first arc-shaped surface and the second arc-shaped surface are respectively configured to match with two notches of the chip module, the first supporting portion is connected to the first protruding block, the first supporting portion and the accommodating hole are located at two opposite sides of the first protruding block, and an extending line of the second protruding block in an extending direction thereof passes above the accommodating hole.

In certain embodiments, the first side wall has an upper surface higher than the first supporting portion, both a top surface of the first protruding block and a top surface of the second protruding block are higher than the upper surface, and the top surface of the first protruding block and the top surface of the second protruding block have different heights.

In certain embodiments, the top surface of the second protruding block is higher than the top surface of the first protruding block.

In certain embodiments, two opposite corners of the first side wall are upward protrudingly provided with two stopping portions respectively, a top surface of each of the stopping portions is higher than the upper surface, and the top surface of the second protruding block is flush with the top surface of each of the stopping portions.

In certain embodiments, the accommodating hole has a first surface and a second surface opposite to each other, the first supporting portion has a vertical surface opposite to an inner surface of the first side wall, and an interval between the vertical surface and the first side wall is greater than an interval between the first surface and the first side wall and is smaller than an interval between the second surface and the first side wall.

In certain embodiments, the vertical surface is tangent to the first arc-shaped surface.

In certain embodiments, the first protruding block has a third surface and a fourth surface opposite to each other, the first arc-shaped surface is connected to the third surface and the fourth surface, the third surface is connected to the first supporting portion, a length of the third surface along a horizontal direction is smaller than a length of the fourth surface along the horizontal direction, the fourth surface intersects with the first arc-shaped surface to form an intersecting line, and an interval between the intersecting line and the first side wall is greater than an interval between the first surface and the first side wall and is smaller than an interval between the second surface and the first side wall.

In certain embodiments, the intersecting line is closer to the first side wall than the vertical surface.

In certain embodiments, the bottom wall is protrudingly provided with a second supporting portion connected to the second protruding block, the second supporting portion is configured to support the chip module, and an interval between an inner surface of the first supporting portion and the first side wall is greater than an interval between an inner surface of the second supporting portion and the second side wall.

In certain embodiments, a groove is provided at a middle position of the second side wall, a top surface of the first supporting portion is flush with a bottom surface of the groove, and the second protruding block is exposed from the groove along a length direction of the second side wall.

To achieve the foregoing objective, the present invention also adopts the following technical solutions.

An electrical connector, configured to be electrically connected to a chip module, includes: a body, having a bottom wall and a first side wall and a second side wall extending upward from the bottom wall and opposite to each other, wherein the bottom wall is provided with an accommodating hole, and a first supporting portion extending upward from the bottom wall and configured to support the chip module; a plurality of terminals, correspondingly accommodated in the body, wherein one of the terminals is accommodated in the accommodating hole; and a first protruding block connected to the first side wall and a second protruding block connected to the second side wall, wherein the first protruding block and the second protruding block extend toward each other, the second protruding block is larger than the first protruding block, the first supporting portion is connected to the first protruding block, the first supporting portion and the accommodating hole are located at two opposite sides of the first protruding block, and an extending line of the second protruding block in an extending direction thereof passes above the accommodating hole.

In certain embodiments, the first side wall has an upper surface higher than the first supporting portion, both a top surface of the first protruding block and a top surface of the second protruding block are higher than the upper surface, and the top surface of the first protruding block and the top surface of the second protruding block have different heights.

In certain embodiments, the top surface of the second protruding block is higher than the top surface of the first protruding block.

In certain embodiments, two opposite corners of the first side wall are upward protrudingly provided with two stopping portions respectively, a top surface of each of the stopping portions is higher than the upper surface, and the top surface of the second protruding block is flush with the top surface of each of the stopping portions.

In certain embodiments, the accommodating hole has a first surface and a second surface opposite to each other, the first supporting portion has a vertical surface opposite to an inner surface of the first side wall, and an interval between the vertical surface and the first side wall is greater than an interval between the first surface and the first side wall and is smaller than an interval between the second surface and the first side wall.

In certain embodiments, the first protruding block has an arc-shaped surface tangent to the vertical surface.

In certain embodiments, the first protruding block has a third surface and a fourth surface opposite to each other, and an arc-shaped surface connecting the third surface and the fourth surface, the third surface is connected to the first supporting portion, a length of the third surface along a horizontal direction is smaller than a length of the fourth surface along the horizontal direction, the fourth surface intersects with the arc-shaped surface to form an intersecting line, and an interval between the intersecting line and the first side wall is greater than an interval between the first surface and the first side wall and is smaller than an interval between the second surface and the first side wall.

In certain embodiments, the intersecting line is closer to the first side wall than the vertical surface.

In certain embodiments, the bottom wall is protrudingly provided with a second supporting portion connected to the second protruding block, the second supporting portion is configured to support the chip module, and an interval between an inner surface of the first supporting portion and the first side wall is greater than an interval between an inner surface of the second supporting portion and the second side wall.

In certain embodiments, a groove is provided at a middle position of the second side wall, a top surface of the first supporting portion is flush with a bottom surface of the groove, and the second protruding block is exposed from the groove along a length direction of the second side wall.

Compared with the related art, the electrical connector according to certain embodiments of the invention have the following beneficial effects:

The second protruding block is larger than the first protruding block, and the extending line of the second protruding block in the extending direction thereof passes above the accommodating hole. In other words, a first protruding block originally having the same size as the second protruding block is partially cut off to provide a space for the accommodating hole to accommodate the terminal, such that the number of the terminals is increased on the premise of keeping the size of the body unchanged, thereby meeting the development requirements of the existing electrical connector. The first supporting portion is connected to the first protruding block, and the first supporting portion and the accommodating hole are located at two opposite sides of the first protruding block to improve the strength of the first protruding block, thereby effectively avoiding damage to the first protruding block caused by collision with an external force, and prolonging the service life of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
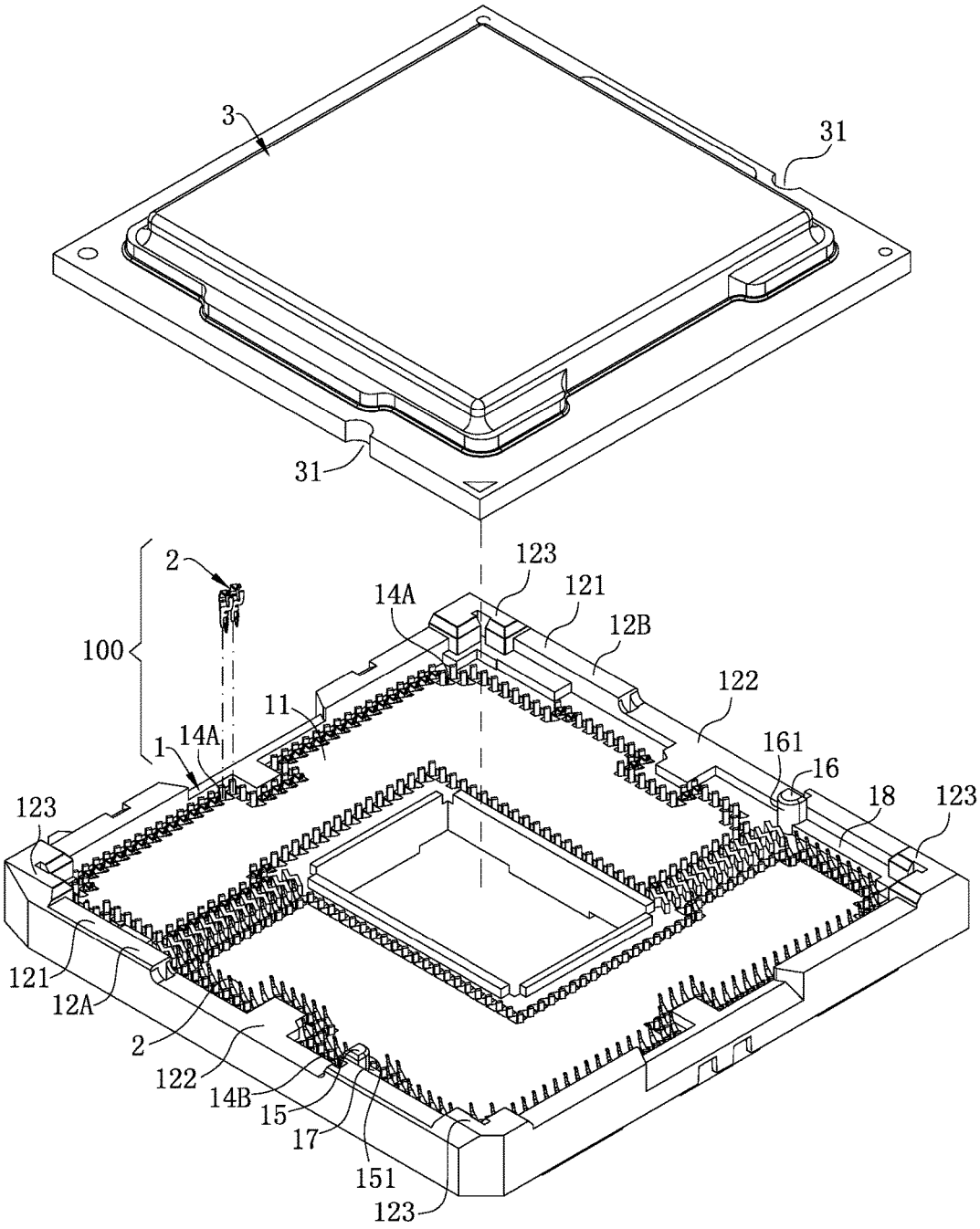
FIG. 1 is a perspective view of an electrical connector and a chip module according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-10. In accordance with the purposes of this invention, as embodied and broadly described herein, this invention, in one aspect, relates to an electrical connector.

Figure 2:
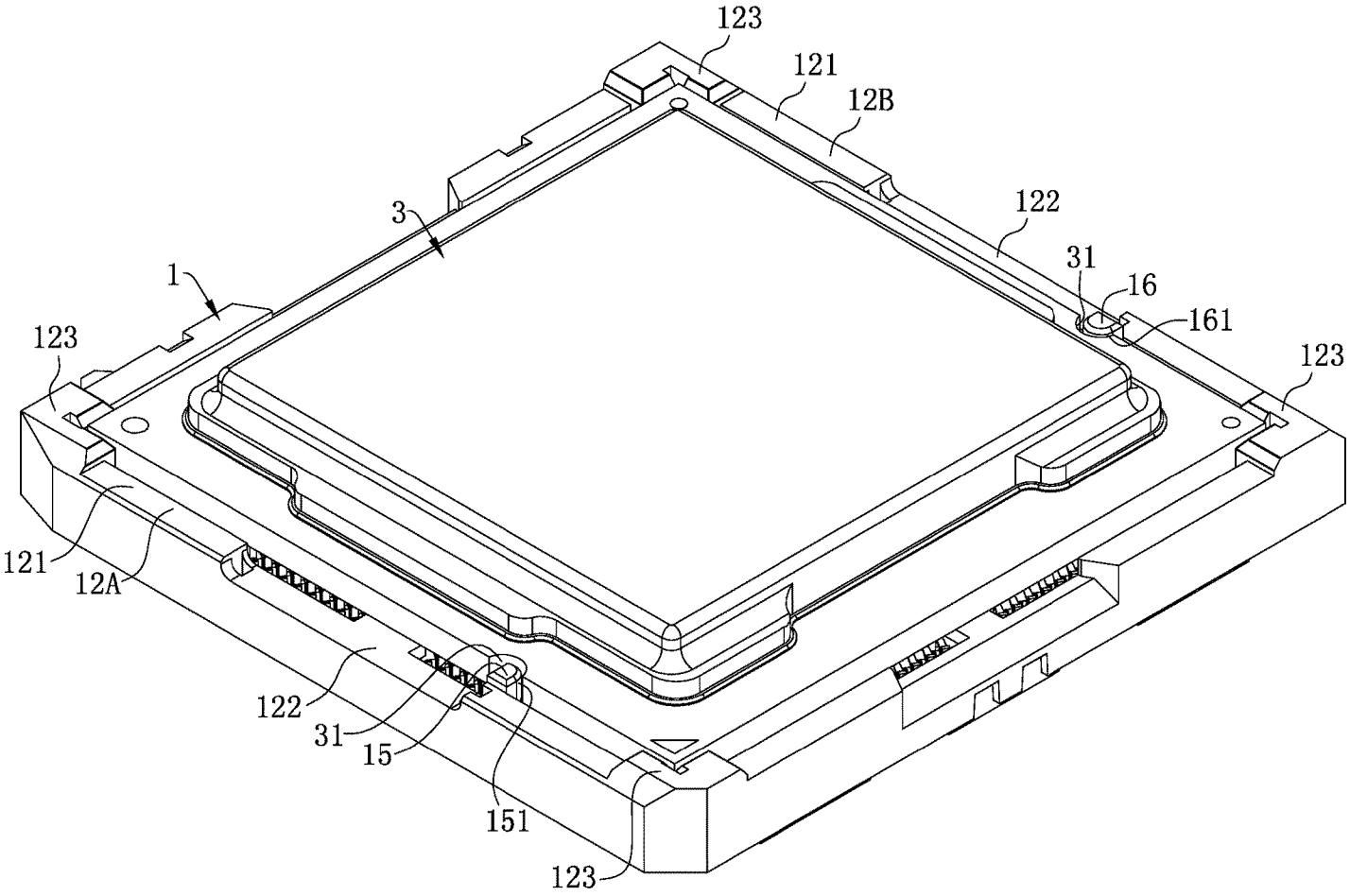
FIG. 2 is a perspective view of the chip module mounted on the electrical connector in FIG. 1.

FIG. 1 and FIG. 2 show an electrical connector 100 according to certain embodiments of the present invention, which is used for electrically connecting a chip module 3. The electrical connector 100 includes a body 1, and multiple terminals 2 accommodated in the body 1.

Figure 3:
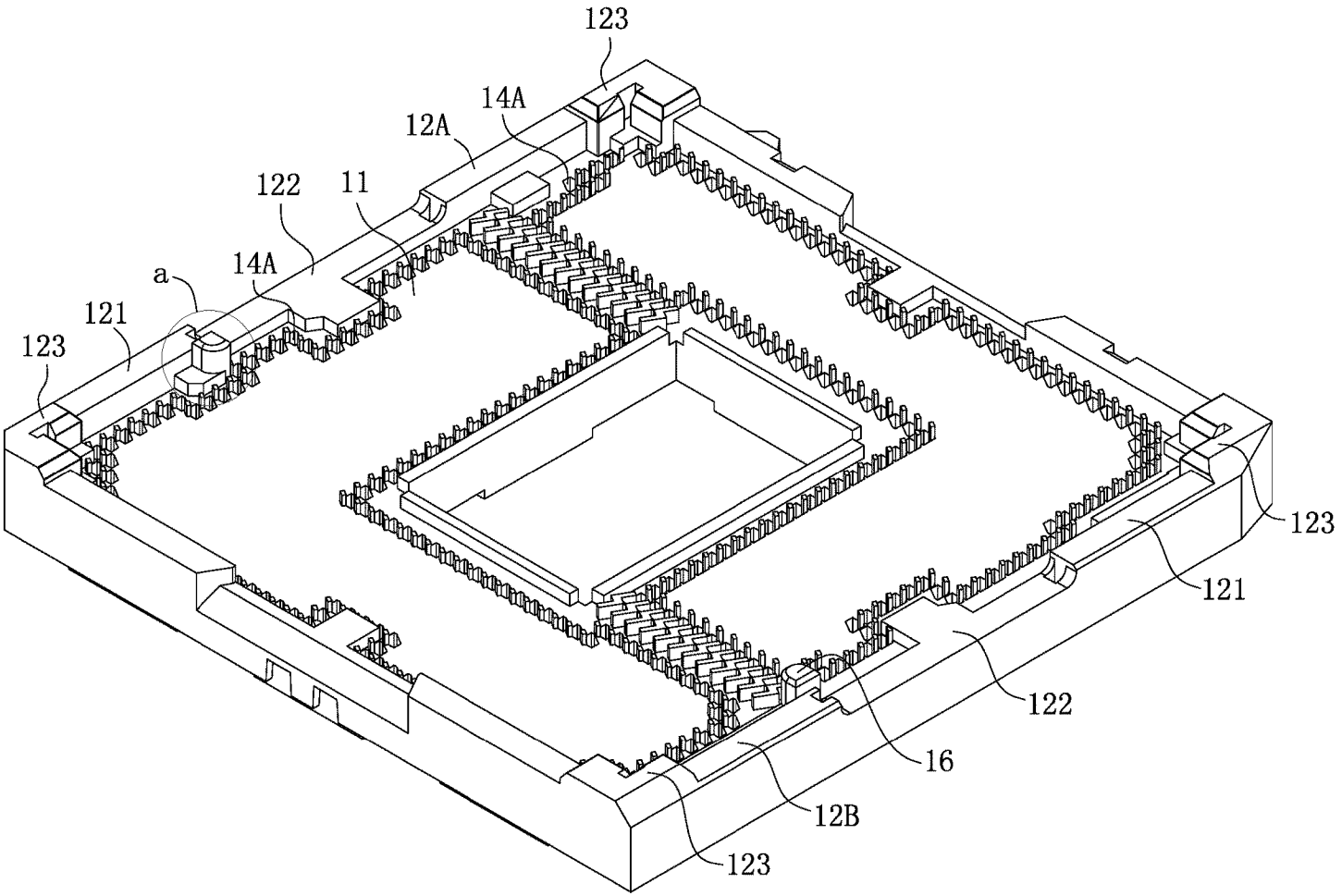
FIG. 3 is a perspective view of a body in FIG. 1 rotated clockwise for 90° in a horizontal direction.
Figure 4:
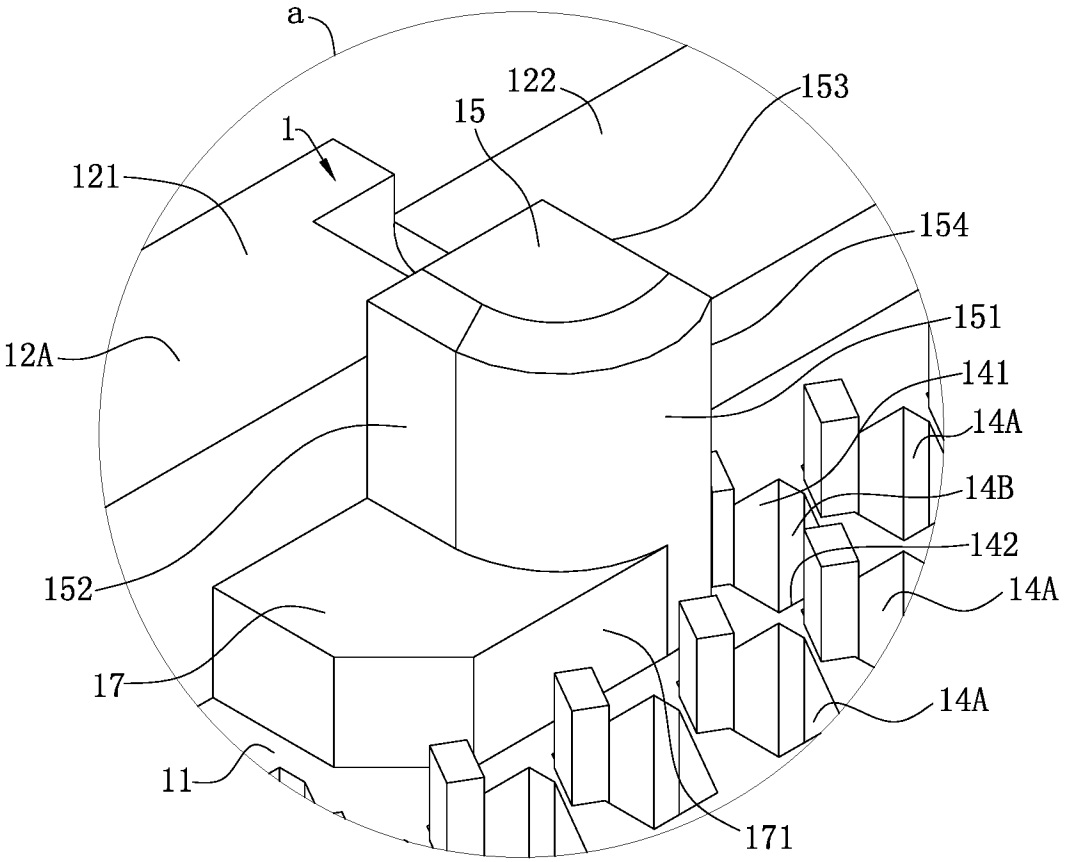
FIG. 4 is an enlarged view of a part a in FIG. 3.

As shown in FIG. 1, FIG. 3 and FIG. 4, the body 1 is made of an insulating material and is used to support the chip module 3 upward. The body 1 has a bottom wall 11, and a first side wall 12A and a second side wall 12B extending upward from the bottom wall 11 and opposite to each other. The bottom wall 11 is provided with multiple through holes 14A and an accommodating hole 14B, used to correspondingly accommodate the terminals 2 respectively.

A first protruding block 15 is connected to the first side wall 12A, and a second protruding block 16 is connected to the second side wall 12B. In the present embodiment, the first protruding block 15 extends from the first side wall 12A toward the second protruding block 16 and is connected to the bottom wall 11, and the second protruding block 16 extends from the second side wall 12B toward the first protruding block 15 and is connected to the bottom wall 11. Of course, in other embodiments, the first protruding block 15 and the second protruding block 16 may also be assembled on the body 1, and there may be multiple first protruding blocks 15 and multiple second protruding blocks 16.

Figure 6:
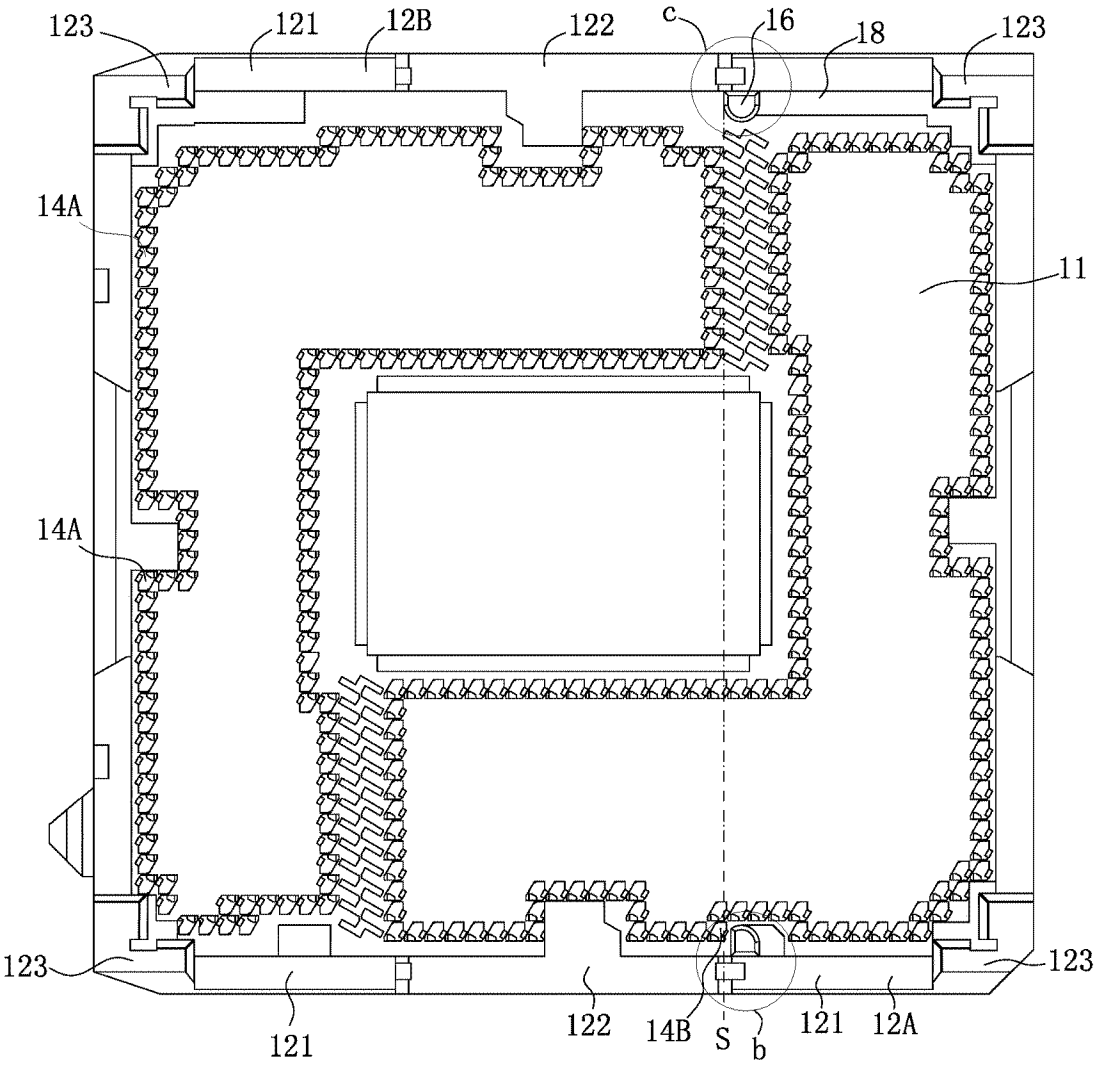
FIG. 6 is a top view of FIG. 5.

As shown in FIG. 1, FIG. 2 and FIG. 6, the first protruding block 15 has a first arc-shaped surface 151, the second protruding block 16 has a second arc-shaped surface 161, and the first arc-shaped surface 151 and the second arc-shaped surface 161 are used to match with two notches 31 on two opposite sides of the chip module 3, so as to position the chip module 3 to make it fool-proof. A width W2 of the second protruding block 16 is greater than a width W1 of the first protruding block 15 (also referring to FIG. 7 and FIG. 8), and an extending line S of the second protruding block 16 in an extending direction thereof passes above the accommodating hole 14B, so as to increase the number of the terminals 2.

Figure 5:
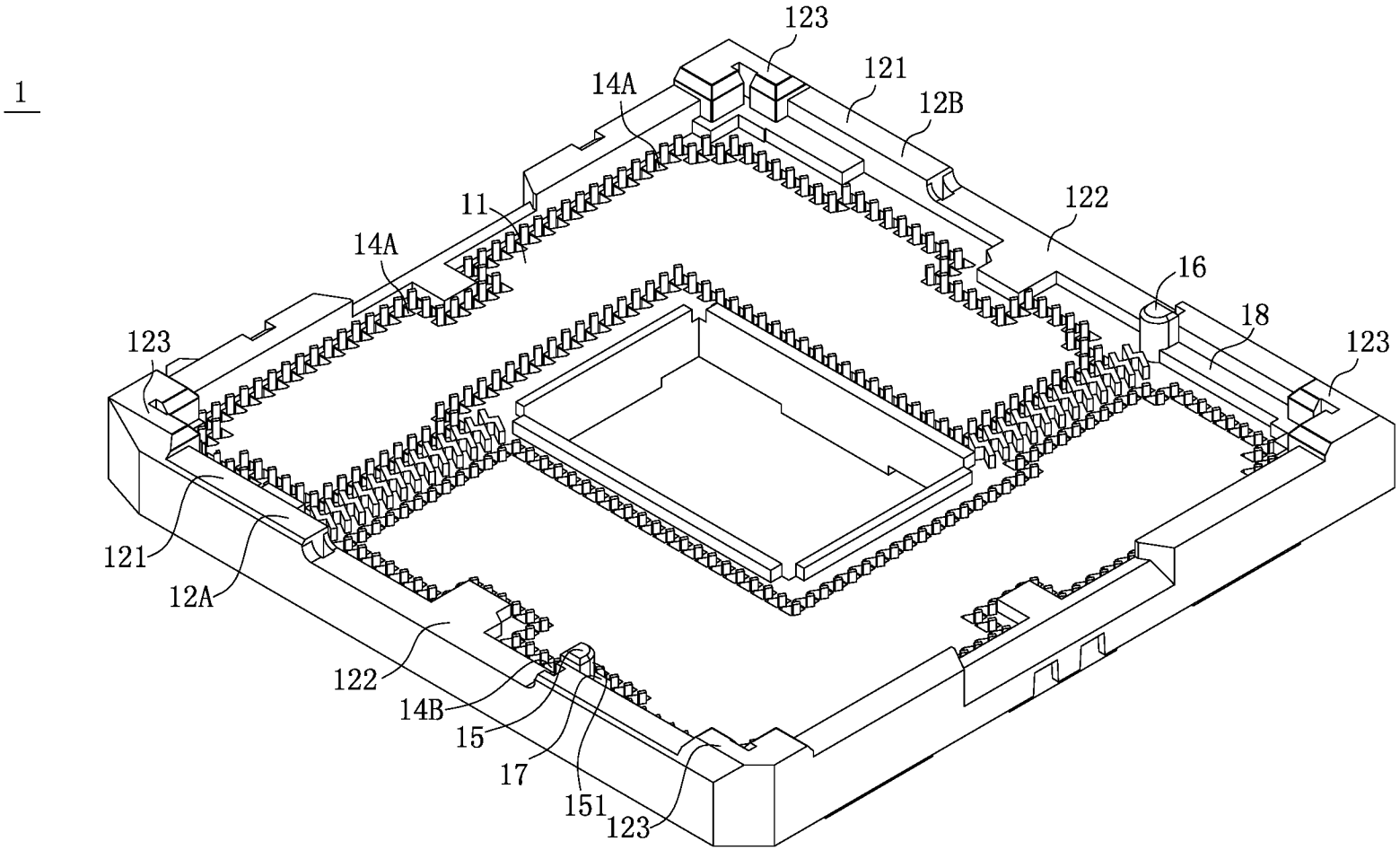
FIG. 5 is a perspective view of the body in FIG. 1.
Figure 7:
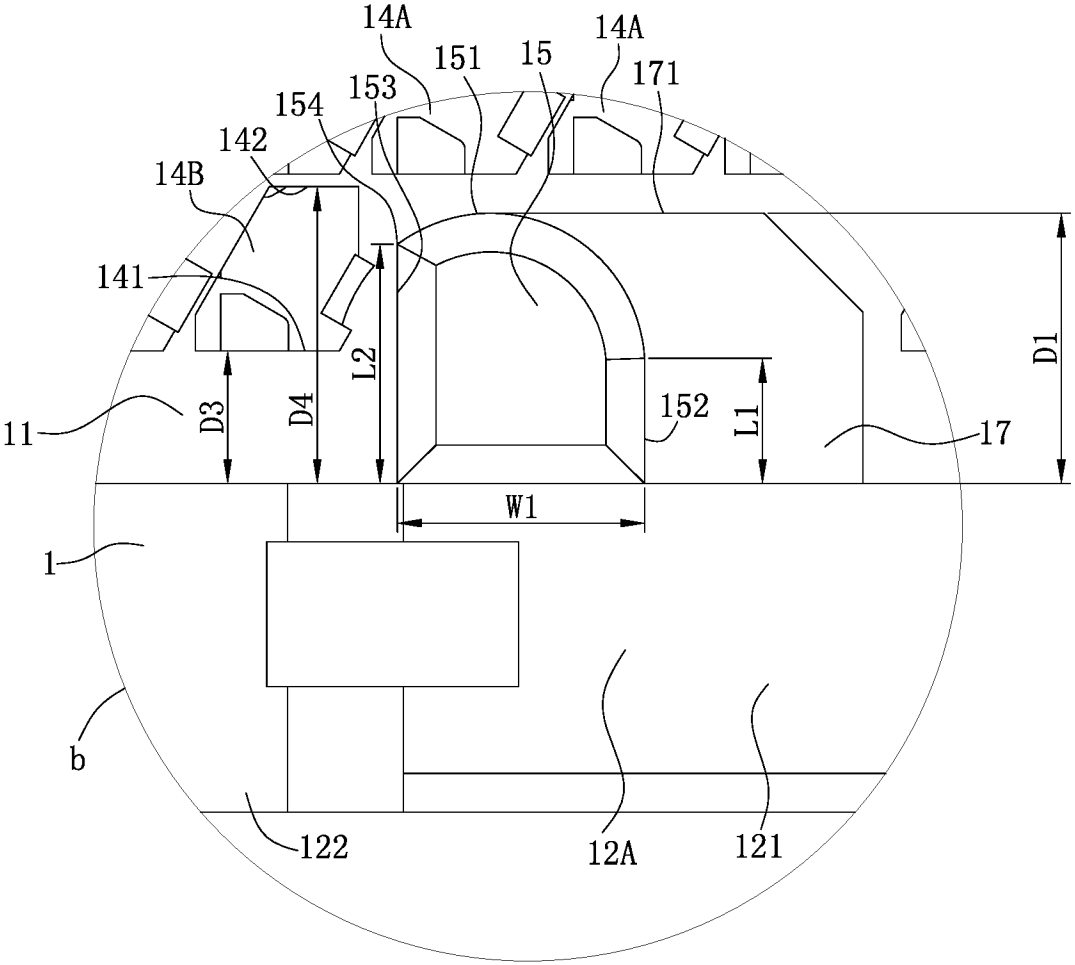
FIG. 7 is an enlarged view of a part b in FIG. 6.
Figure 8:
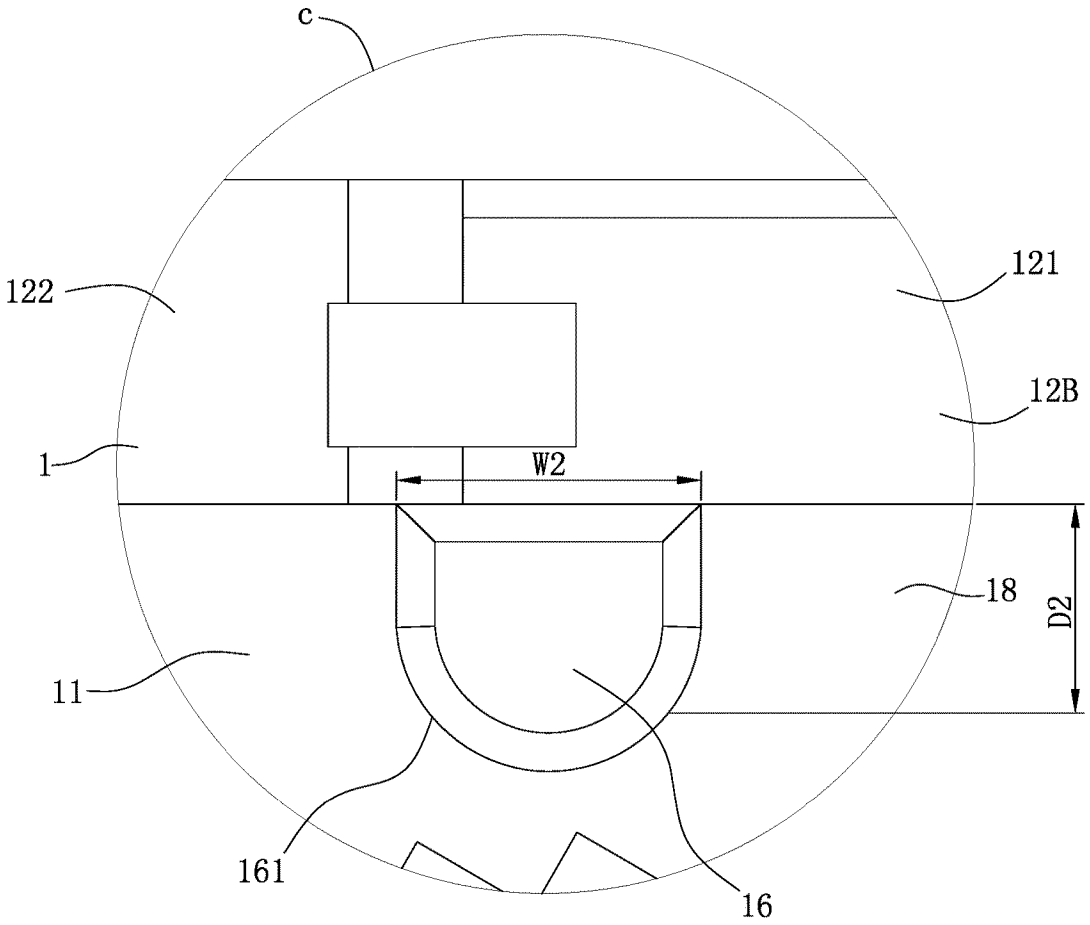
FIG. 8 is an enlarged view of a part c in FIG. 6.

As shown in FIG. 5, FIG. 7 and FIG. 8, the bottom wall 11 is upward protrudingly provided with a first supporting portion 17, which is connected to the first protruding block 15, and a second supporting portion 18, which is connected to the second protruding block 16. The first supporting portion 17 and the second supporting portion 18 are used to support the chip module 3 upward. An interval D1 between an inner surface of the first supporting portion 17 and the first side wall 12A is greater than an interval D2 between an inner surface of the second supporting portion 18 and the second side wall 12B, and the first supporting portion 17 and the accommodating hole 14B are located at two opposite sides of the first protruding block 15, so as to improve the strength of the first protruding block 15.

As shown in FIG. 3, FIG. 4 and FIG. 7, the accommodating hole 14B has a first surface 141 and a second surface 142 opposite to each other. The first supporting portion 17 has a vertical surface 171 opposite to an inner surface of the first side wall 12A. An interval D1 between the vertical surface 171 and the first side wall 12A is greater than an interval D3 between the first surface 141 and the first side wall 12A and is smaller than an interval D4 between the second surface 142 and the first side wall 12A, such that the accommodating hole 14B and the through holes 14A in an adjacent row are distributed more compactly to fully utilize the space of the body 1 to additionally provide the accommodating hole 14B.

The vertical surface 171 is tangent to the first arc-shaped surface 151, so as to increase a connection area between the first supporting portion 17 and the first protruding block 15, thereby improving the strength of the first protruding block 15.

The first protruding block 15 has a third surface 152 and a fourth surface 153 opposite to each other. The first arc-shaped surface 151 is connected to the third surface 152 and the fourth surface 153. The third surface 152 is connected to the first supporting portion 17, and a length L1 of the third surface 152 along a horizontal direction is smaller than a length L2 of the fourth surface 153 along the horizontal direction.

The fourth surface 153 intersects with the first arc-shaped surface 151 to form an intersecting line 154. An interval L2 between the intersecting line 154 and the first side wall 12A is greater than an interval D3 between the first surface 141 and the first side wall 12A and is smaller than an interval D4 between the second surface 142 and the first side wall 12A. The intersecting line 154 is closer to the first side wall 12A than the vertical surface 171. That is, L2 is smaller than D1.

Figure 9:
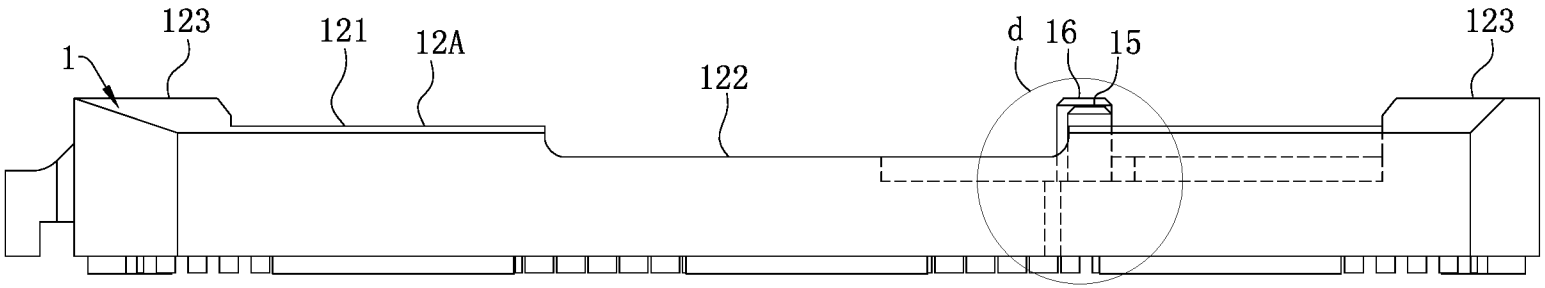
FIG. 9 is a front view of FIG. 5.

As shown in FIG. 5 and FIG. 9, the first side wall 12A has an upper surface 121 higher than the first supporting portion 17 and the second supporting portion 18, such that the first side wall 12A stops the chip module 3 from moving along the horizontal direction. Both a top surface of the first protruding block 15 and a top surface of the second protruding block 16 are higher than the upper surface 121, thereby making it convenient to mount the chip module 3 on the body 1 downward.

As shown in FIG. 1 and FIG. 2, since the first protruding block 15 is smaller than the second protruding block 16 and the two notches 31 of the chip module 3 are equal in size, an interval between the first protruding block 15 and the corresponding notch 31 is larger. If the top surface of the second protruding block 16 and the top surface of the first protruding block 15 have equal heights, when the chip module 3 is vertically mounted on the body 1, a positioning effect between the first protruding block 15 and the corresponding notch 31 is poor, thereby making it inconvenient to mount the chip module 3.

Figure 10:
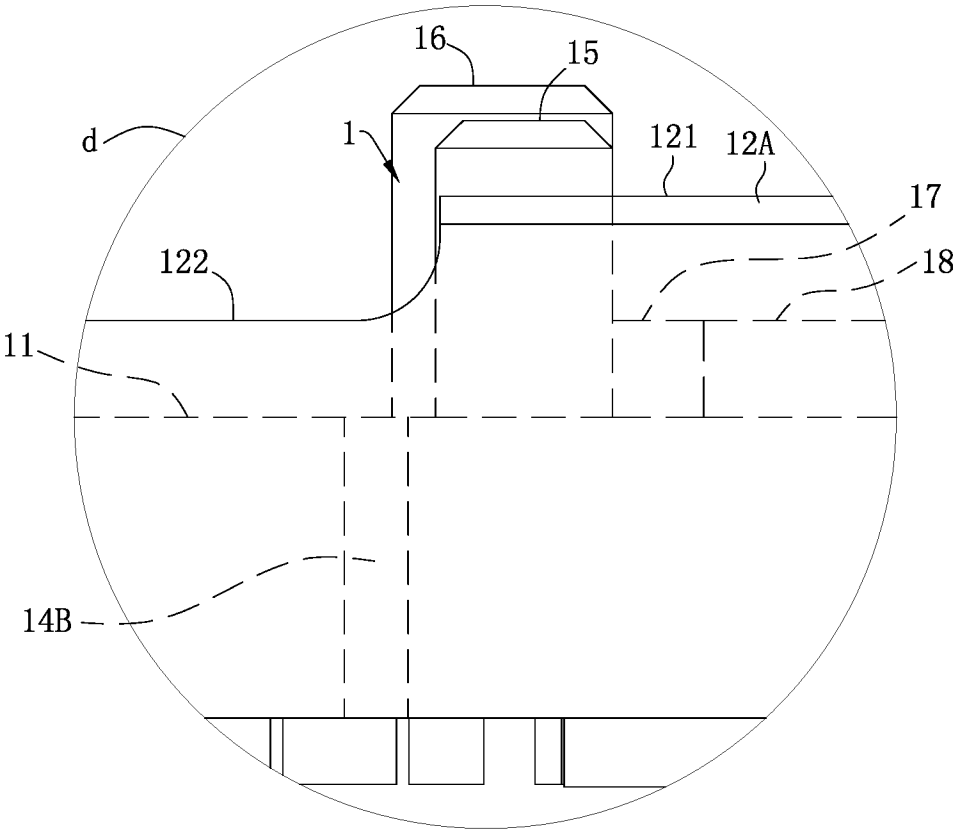
FIG. 10 is an enlarged view of a part d in FIG. 9.

As shown in FIG. 9 and FIG. 10, in the present embodiment, the top surface of the second protruding block 16 is higher than the top surface of the first protruding block 15, and the chip module 3 may be mounted obliquely relative to the body 1. Of course, the chip module 3 may also be vertically mounted on the body 1. At this time, the second arc-shaped surface 161 of the second protruding block 16 may firstly mate with the corresponding notch 31 to achieve pre-positioning, and then the chip module 3 is gradually flattened until the first arc-shaped surface 151 of the first protruding block 15 mates with the corresponding notch 31, such that the chip module 3 may be correctly mounted in the body 1, thereby reducing the mounting difficulty of the chip module 3. Of course, in other embodiments, the top surface of the first protruding block 15 may also be higher than the top surface of the second protruding block 16.

As shown in FIG. 5 and FIG. 10, a groove 122 is provided at a middle position of the first side wall 12A. The groove 122 runs through the first side wall 12A along a front-rear direction to make it convenient for an operator to grab the chip module 3, and a top surface of the first supporting portion 17 is flush with a bottom surface of the groove 122, thereby facilitating processing of the body 1, and ensuring the strength of the groove 122.

As shown in FIG. 5 and FIG. 9, two opposite corners of the first side wall 12A are upward protrudingly provided with two stopping portions 123 respectively. A top surface of each stopping portion 123 is higher than the upper surface 121, and the top surface of the second protruding block 16 is flush with the top surface of each stopping portion 123, thereby ensuring the flatness, making it convenient for the multiple bodies 1 to be smoothly stacked together in a production or transportation process, and reducing the occupied space.

As shown in FIG. 5, the second side wall 12B and the first side wall 12A have the same structure. That is, the second side wall 12B also has the upper surface 121, the groove 122 and the stopping portion 123.

As shown in FIG. 5 and FIG. 10, one side of the second protruding block 16 is flush with the third surface 152 of the first protruding block 15 along a length direction of the second side wall 12B, and the opposite side of the second protruding block 16 is exposed from the groove 122. When the chip module 3 is mounted, an operator may observe the mating situation between the second protruding block 16 and the notch 31 through the groove 122, in order to timely adjust the positions of the second protruding block 16 and the notch 31, thereby reducing the mounting difficulty of the chip module 3.

To sum up, the electrical connector according to certain embodiments of the present invention has the following beneficial effects:

(1) The second protruding block 16 is larger than the first protruding block 15, and the extending line S of the second protruding block 16 in the extending direction thereof passes above the accommodating hole 14B. In other words, the first protruding block 15 originally having the same size as the second protruding block 16 is partially cut off to provide a space for the accommodating hole 14B to accommodate the terminal 2, such that the number of the terminals 2 is increased on the premise of keeping the size of the body 1 unchanged, thereby meeting the development requirements of the existing electrical connector 100. The first supporting portion 17 is connected to the first protruding block 15, and the first supporting portion and the accommodating hole 14B are located at two opposite sides of the first protruding block 15 to improve the strength of the first protruding block 15, thereby effectively avoiding damage to the first protruding block 15 caused by collision with an external force, and prolonging the service life of the electrical connector 100.

(2) An interval D1 between the vertical surface 171 and the first side wall 12A is greater than an interval D3 between the first surface 141 and the first side wall 12A and is smaller than an interval D4 between the second surface 142 and the first side wall 12A, such that the accommodating hole 14B and the through holes 14A in an adjacent row are distributed more compactly to fully utilize the space of the body 1 to additionally provide the accommodating hole 14B.

(3) The top surface of the second protruding block 16 is higher than the top surface of the first protruding block 15, and the chip module 3 may be mounted obliquely relative to the body 1. Of course, the chip module 3 may also be vertically mounted on the body 1. At this time, the second arc-shaped surface 161 of the second protruding block 16 may firstly mate with the corresponding notch 31 to achieve pre-positioning, and then the chip module 3 is gradually flattened until the first arc-shaped surface 151 of the first protruding block 15 mates with the corresponding notch 31, such that the chip module 3 may be correctly mounted in the body 1, thereby reducing the mounting difficulty of the chip module 3.

(4) One side of the second protruding block 16 is flush with the third surface 152 of the first protruding block 15 along a length direction of the second side wall 12B, and the opposite side of the second protruding block 16 is exposed from the groove 122. When the chip module 3 is mounted, an operator may observe the mating situation between the second protruding block 16 and the notch 31 through the groove 122, in order to timely adjust the positions of the second protruding block 16 and the notch 31, thereby reducing the mounting difficulty of the chip module 3.

(5) Two opposite corners of the first side wall 12A are upward protrudingly provided with two stopping portions 123 respectively. A top surface of each stopping portion 123 is higher than the upper surface 121, and the top surface of the second protruding block 16 is flush with the top surface of each stopping portion 123, thereby ensuring the flatness, making it convenient for the multiple bodies 1 to be smoothly stacked together in a production or transportation process, and reducing the occupied space.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected to a chip module, comprising:

a body, having a bottom wall and a first side wall and a second side wall extending upward from the bottom wall and opposite to each other, wherein the bottom wall is provided with an accommodating hole, and a first supporting portion extending upward from the bottom wall and configured to support the chip module;

a plurality of terminals, correspondingly accommodated in the body, wherein one of the terminals is accommodated in the accommodating hole; and a first protruding block connected to the first side wall and a second protruding block connected to the second side wall, wherein the first protruding block and the second protruding block extend toward each other along an extending direction, the first protruding block is partially cut off to provide a cut-off space such that the second protruding block is larger than the first protruding block, the first protruding block has a first arc-shaped surface, the second protruding block has a second arc-shaped surface, the first arc-shaped surface and the second arc-shaped surface are respectively configured to match with two notches of the chip module, the first supporting portion is connected to the first protruding block, the first supporting portion and the accommodating hole are located at two opposite sides of the first protruding block, the accommodating hole is provided on the bottom wall to at least partially overlap with the cut-off space along a vertical direction perpendicular to the bottom wall, and an extending line of the second protruding block in the extending direction passes above the accommodating hole.

2. The electrical connector of claim 1, wherein the first side wall has an upper surface higher than the first supporting portion, both a top surface of the first protruding block and a top surface of the second protruding block are higher than the upper surface, and the top surface of the first protruding block and the top surface of the second protruding block have different heights.

3. The electrical connector of claim 2, wherein two opposite corners of the first side wall are upward protrudingly provided with two stopping portions respectively, a top surface of each of the stopping portions is higher than the upper surface, and the top surface of the second protruding block is flush with the top surface of each of the stopping portions.

4. The electrical connector of claim 1, wherein the accommodating hole has a first surface and a second surface opposite to each other, the first supporting portion has a vertical surface opposite to an inner surface of the first side wall, and an interval between the vertical surface and the first side wall is greater than an interval between the first surface and the first side wall and is smaller than an interval between the second surface and the first side wall.

5. The electrical connector of claim 4, wherein the vertical surface is tangent to the first arc-shaped surface.

6. The electrical connector of claim 4, wherein the first protruding block has a third surface and a fourth surface opposite to each other, the first arc-shaped surface is connected to the third surface and the fourth surface, the third surface is connected to the first supporting portion, a length of the third surface along a horizontal direction is smaller than a length of the fourth surface along the horizontal direction, the fourth surface intersects with the first arc-shaped surface to form an intersecting line, and an interval between the intersecting line and the first side wall is greater than an interval between the first surface and the first side wall and is smaller than an interval between the second surface and the first side wall.

7. The electrical connector of claim 6, wherein the intersecting line is closer to the first side wall than the vertical surface.

8. The electrical connector of claim 1, wherein the bottom wall is protrudingly provided with a second supporting portion connected to the second protruding block, the second supporting portion is configured to support the chip module, and an interval between an inner surface of the first supporting portion and the first side wall is greater than an interval between an inner surface of the second supporting portion and the second side wall.

9. The electrical connector of claim 1, wherein a groove is provided at a middle position of the second side wall, a top surface of the first supporting portion is flush with a bottom surface of the groove, and the second protruding block is exposed from the groove along a length direction of the second side wall.

10. The electrical connector of claim 1, wherein the accommodating hole has a first surface and a second surface opposite to each other, the first surface and the second surface are respectively parallel to an inner surface of the first side wall, and the first protruding block is partially located between an extension surface of the first surface and an extension surface of the second surface.

11. An electrical connector, configured to be electrically connected to a chip module, comprising:

a body, having a bottom wall and a first side wall and a second side wall extending upward from the bottom wall and opposite to each other, wherein the bottom wall is provided with an accommodating hole, and a first supporting portion extending upward from the bottom wall and configured to support the chip module;

a plurality of terminals, correspondingly accommodated in the body, wherein one of the terminals is accommodated in the accommodating hole; and a first protruding block connected to the first side wall and a second protruding block connected to the second side wall, wherein the first protruding block and the second protruding block extend toward each other along an extending direction, the first protruding block is partially cut off to provide a cut-off space such that the second protruding block is larger than the first protruding block, the first supporting portion is connected to the first protruding block, the first supporting portion and the accommodating hole are located at two opposite sides of the first protruding block, the accommodating hole is provided on the bottom wall to at least partially overlap with the cut-off space along a vertical direction perpendicular to the bottom wall, and an extending line of the second protruding block in an extending direction thereof passes above the accommodating hole.

12. The electrical connector of claim 11, wherein the first side wall has an upper surface higher than the first supporting portion, both a top surface of the first protruding block and a top surface of the second protruding block are higher than the upper surface, and the top surface of the first protruding block and the top surface of the second protruding block have different heights.

13. The electrical connector of claim 12, wherein two opposite corners of the first side wall are upward protrudingly provided with two stopping portions respectively, a top surface of each of the stopping portions is higher than the upper surface, and the top surface of the second protruding block is flush with the top surface of each of the stopping portions.

14. The electrical connector of claim 11, wherein the accommodating hole has a first surface and a second surface opposite to each other, the first supporting portion has a vertical surface opposite to an inner surface of the first side wall, and an interval between the vertical surface and the first side wall is greater than an interval between the first surface and the first side wall and is smaller than an interval between the second surface and the first side wall.

15. The electrical connector of claim 14, wherein the first protruding block has an arc-shaped surface tangent to the vertical surface.

16. The electrical connector of claim 14, wherein the first protruding block has a third surface and a fourth surface opposite to each other, and an arc-shaped surface connecting the third surface and the fourth surface, the third surface is connected to the first supporting portion, a length of the third surface along a horizontal direction is smaller than a length of the fourth surface along the horizontal direction, the fourth surface intersects with the arc-shaped surface to form an intersecting line, and an interval between the intersecting line and the first side wall is greater than an interval between the first surface and the first side wall and is smaller than an interval between the second surface and the first side wall.

17. The electrical connector of claim 16, wherein the intersecting line is closer to the first side wall than the vertical surface.

18. The electrical connector of claim 11, wherein the bottom wall is protrudingly provided with a second supporting portion connected to the second protruding block, the second supporting portion is configured to support the chip module, and an interval between an inner surface of the first supporting portion and the first side wall is greater than an interval between an inner surface of the second supporting portion and the second side wall.

19. The electrical connector of claim 11, wherein a groove is provided at a middle position of the second side wall, a top surface of the first supporting portion is flush with a bottom surface of the groove, and the second protruding block is exposed from the groove along a length direction of the second side wall.

20. The electrical connector of claim 11, wherein the accommodating hole has a first surface and a second surface opposite to each other, the first surface and the second surface are respectively parallel to an inner surface of the first side wall, and the first protruding block is partially located between an extension surface of the first surface and an extension surface of the second surface.

* * * * *